United States Patent [19]

Schliefer et al.

[11] 4,065,250

[45] Dec. 27, 1977

[54] METHOD OF INDEPENDENTLY ADJUSTING THE FUEL MIXTURE COMPOSITION AND MELTING RATE OF MULTIBURNER SHAFT FURNACES FOR MELTING METALS

[75] Inventors: Heinrich Schliefer; Friedrich Wilhelm Warnecke, both of Hamburg, Germany

[73] Assignee: Norddeutsche Affinerie, Hamburg, Germany

[21] Appl. No.: 678,663

[22] Filed: Apr. 20, 1976

[30] Foreign Application Priority Data

Apr. 23, 1975 Germany ..... 2517957

[51] Int. Cl.[2] ..... F27D 7/00

[52] U.S. Cl. ..... 432/24; 431/18; 431/90; 432/36; 432/96

[58] Field of Search ..... 432/36, 37, 51, 45, 432/96, 24; 431/18, 90

[56] References Cited

U.S. PATENT DOCUMENTS

| | | | |
|---|---|---|---|
| 2,296,256 | 9/1942 | Bloom | 431/90 |
| 2,594,430 | 4/1952 | Hansen | 431/90 |
| 3,015,357 | 1/1962 | Bain et al. | 432/37 |
| 3,050,018 | 8/1962 | Pearson | 432/37 X |
| 3,345,846 | 10/1967 | Hess | 432/43 |
| 3,741,710 | 6/1973 | Nelson | 431/90 |

*Primary Examiner*—John J. Camby
*Attorney, Agent, or Firm*—Karl F. Ross

[57] ABSTRACT

A method of independently adjusting the fuel mixture composition and heating rate for a multiburner shaft furnace for the melting of metal, particularly copper and its alloys, fed in lump form to the shaft furnace, in which the burners are supplied with air and fuel gas and the heating rate is adjusted by controlling the pressure of one of the components of the fuel mixture (air or gas) in the manifold for supplying this component to a group of burners. The other fuel mixture component has its pressure controlled in its manifold by a single controller constituted by a pressure ratio controller.

11 Claims, 4 Drawing Figures

PRIOR ART

METHOD OF INDEPENDENTLY ADJUSTING THE FUEL MIXTURE COMPOSITION AND MELTING RATE OF MULTIBURNER SHAFT FURNACES FOR MELTING METALS

FIELD OF THE INVENTION

This invention relates to a method of independently adjusting the air/fuel mixture composition and the heating capacity of multiburner shaft furnaces for melting metals, particularly copper and its alloys, in which shaft furnaces the burners are supplied with pressurized air as well as fuel gas, the heating rate being adjusted by controlling the pressure of one component of the fuel air mixture in the manifold for supplying said component to a group of burners.

BACKGROUND OF THE INVENTION

It is good practice to arrange the burners in rows and to adjust the heating rate by control of the pressure of the combustion air for each row's piping manifold. The rate at which combustion air flows to each burner depends on the substantially constant flow resistance presented by the supply conduits and the restrictions incorporated therein. A separate pressure controller, referred to as a zero regulator, is associated with each burner to ensure the same pressure of the gaseous or vaporous fuel as the pressurized air. Downstream of each zero regulator manually adjustable throttle valve is provided in the fuel gas conduit effecting the adjustment of the fuel-air ratio.

Said shaft furnaces as well as the method of adjusting the heating rate have found widespread use and have been adapted to various additional conditions, such as fuel composition, charge analysis, and metallurgical process needs (German Pat. Specification No. 1,301,583, Printed German Application NO. 2,062,144).

Multiple technical conditions must be coordinated and suitably adjusted to obtain satisfactory results in the economical and metallurgical aims when operating such furnaces.

In the operation of furnaces of this kind it has been found to be particularly difficult to achieve all design-an operating conditions without adverse interdependence.

OBJECT OF THE INVENTION

It is the object of the invention to eliminate disadvantages of the known methods and to provide simple means of adjustment of the fuel-air ratio for burner groups or for all burners simultaneously, also from a remote control room and to ensure that the adjusted ratio will be held constant.

SUMMARY OF THE INVENTION

This object is accomplished in that the pressure of the other air/fuel mixture component in the manifold for supplying said other component to the same burner group is controlled by a single controller being a pressure ratio controller (rather than a zero regulator for each burner).

The shaft furnace adapted for the use of the method according to the invention is more straightforward and yields more economical operation because the large number of zero regulators is eliminated.

The remaining throttle valves serve only for compensating differences in the flow resistances of the conduits. As such compensation is required only once, the throttling valves can be replaced by properly sized, fixed restrictions.

Preferred features of the method according to the invention reside in that:

The air pressure, which determines the heating rate, is used as setpoint for the pressure ratio controller;

The pressure ratio can be remotely adjusted; and

The pressure ratio can be automatically varied as a function of the air temperature and/or a process parameter.

The pressure ratio may be automatically adjusted, e.g. in dependence of the oxygen content of the molten metal, if this oxygen content is to be maintained at a predetermined level.

According to another preferred feature of the invention, the pressure ratio is automatically controlled in dependence of the flow rate in one burner group and this control is used, alone or as a contributing function, for compensating the deviation of the dependence between flow rate and pressure loss from an exactly square function.

The pressures of air and fuel in the respective manifolds may be measured by square-root-extracting instruments, in known manner, so that the melting rate, which varies approximately with the square of the pressure of the air above atmospheric pressure, can be adjusted linearly. In that case, errors of the pressure-measuring means will additionally be weighted in dependence on the heating rate.

The use of the invention eliminates the need for the widespread preheating of the fuel because fluctuations of the temperature of the pressurized air can be compensated for by a correction of the fuel-air ratio from a central location. In accordance with the invention, the fuel, which is not preheated, is introduced into a mixing chamber, which is known per se and which precedes each burner and is designed in accordance with technological requirements.

The resulting fuel-air mixture can be monitored by flow measuring restrictions provided in the air and fuel supply conduits in conjunction with transmitters or transducers, known per se, and ratio computers.

More than one pair of restrictions are suitable associated with each pair of differential pressure transducers and the ratio computer connected thereto be means of switched valves.

Finally, the method according to the invention may be carried out in such a manner that the final control valves in the air manifolds open and the final control valves in the fuel manifolds close when the furnace is shut down or in case of a failure of the auxiliary power for the control means.

The use of the method according to the invention results in a particularly uniform and trouble-free and, for that reason, economical operation of a shaft furnace.

BRIEF DESCRIPTION OF THE DRAWING

The invention will be explained more fully and by way of example with reference to the drawing and distinguished from the known mode of operation. In the drawing:

FIG. 3 is a detailed fragmentary view showing a portion of FIG. 2 and illustrates the possibility to set the ratio controller in dependence upon temperature, $O_2$-content, and the like.

SPECIFIC DESCRIPTION

Figure 1:
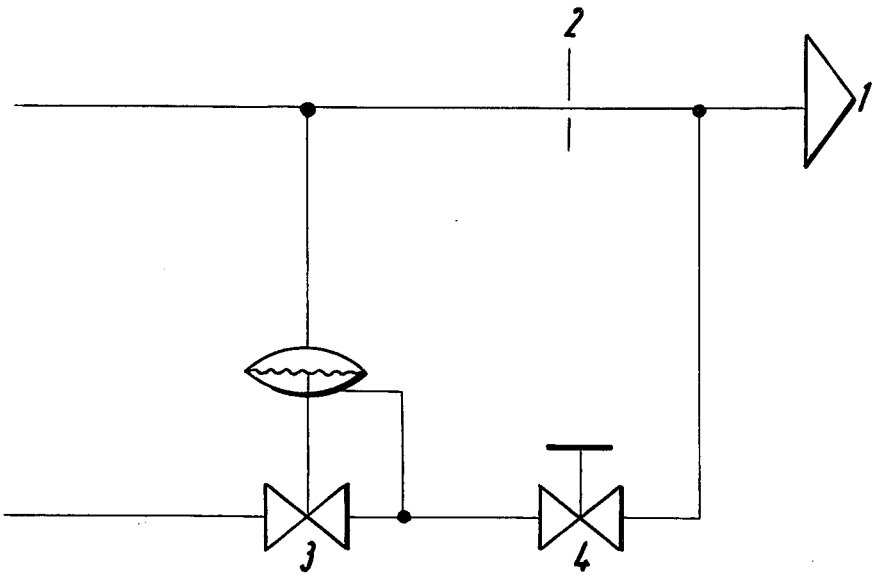
FIG. 1 is highly diagrammatic view showing the known mode of operation.

The known system shown in FIG. 1 comprises a burner 1, a localized flow resistance 2 of the air conduit, a known zero regulator 3, and an adjustable throttle valve 4. In accordance with the laws of flow dynamics, the ratio of the mass flow rates of the air and fuel will depend only on the setting of the valve 4 if the zero regulator operates properly and the density of the air and of the fuel are constant. When it is desired to change that ratio, e.g., to provide for a certain oxygen content of the molten metal, it is necessary, e.g., to adjust the corresponding valves 4 at each burner or, as has been proposed in the Proceedings of the American Institute of Metallurgical Engineers (AIMA) of the 101st Annual Meeting 1972, to control the densities.

Figure 2:
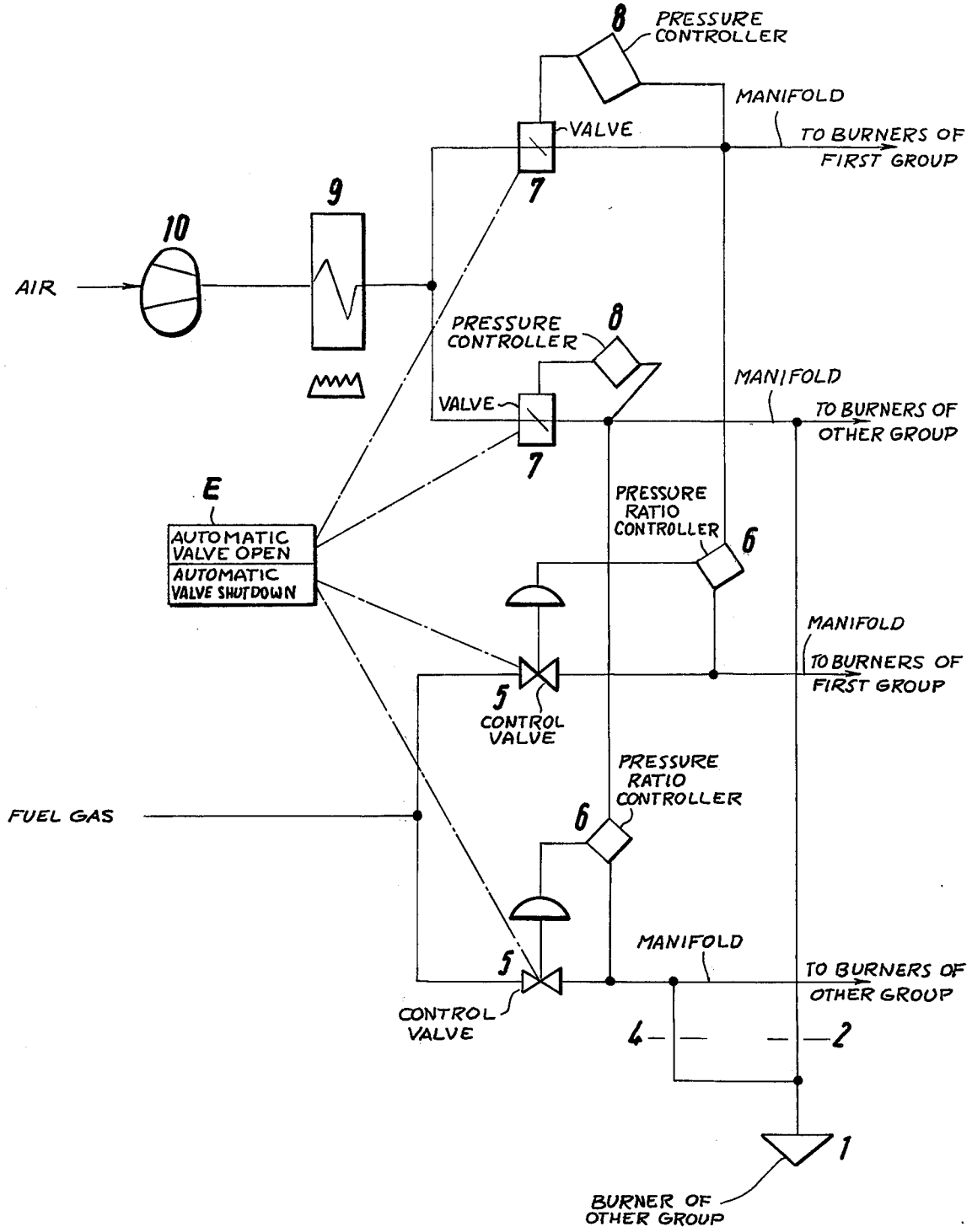
FIG. 2 is a highly diagrammatic overall circuit diagram illustrating the method according to the invention as applied to a shaft furnace having two rows of burners.

FIG. 2 shows an air compressor 10, which is driven by a motor, not shown, and which in known manner compresses air to a substantially constant pressure. The pressurized air is heated to a substantially constant temperature by a heat exchanger 9, which is directly or extraneously or recuperatively heated. The value of said temperature is suitably determined in known manner by the properties of the fuel employed.

Pressure controllers 8 and final control valves 7 associated therewith provide for an automatic control of the pressure in the manifolds, connected by branch conduits to the individual burners, at a selectable, constant value. For the sake of clearness, only one burner 1 of these burners is shown. The resistance to the flow of air is represented by the idealized or actual restriction 2.

The gaseous or vaporous fuel is fed to the final control valves 5, preferably under a constant pressure. The final control valves 5 cooperate with the controllers 6, which consist of ratio controllers, known per se. They serve to maintain a constant ratio, e.g. ratio one between the air and gas pressures. An idealized or actual restriction representing the resistance to the flow of the fuel is shown at 4. As in the known arrangement shown in FIG. 1, in which a zero regulator is associated with each burner, the ratio between the mass flow rates at which air and gas are supplied to the burner depends only on the ratio of the resistances represented at 2 and 4, if the theoretical influence of the density of the fluids is taken into account in determining the resistance to flow and the pressure behind the final control valves 5 and 7 are, e.g., equal. If the controllers 6 are ratio controllers, it is possible in theory and practice to control the mass flow rate ratio between air and gas by an adjustment of the set pressure ratio at the controller 6 from a central location whereas the ratio between the flow resistance 2 and 4 remains constant. This control action will be the same for all burners connected in a row if there are only slight pressure drops along the manifold. This is an additional requirement of the invention and can easily be complied with. Control E automatically opens valves 7 and closes valves 5 in the event of failure (e.g. loss of electrical power) in the control system.

Figure 3:
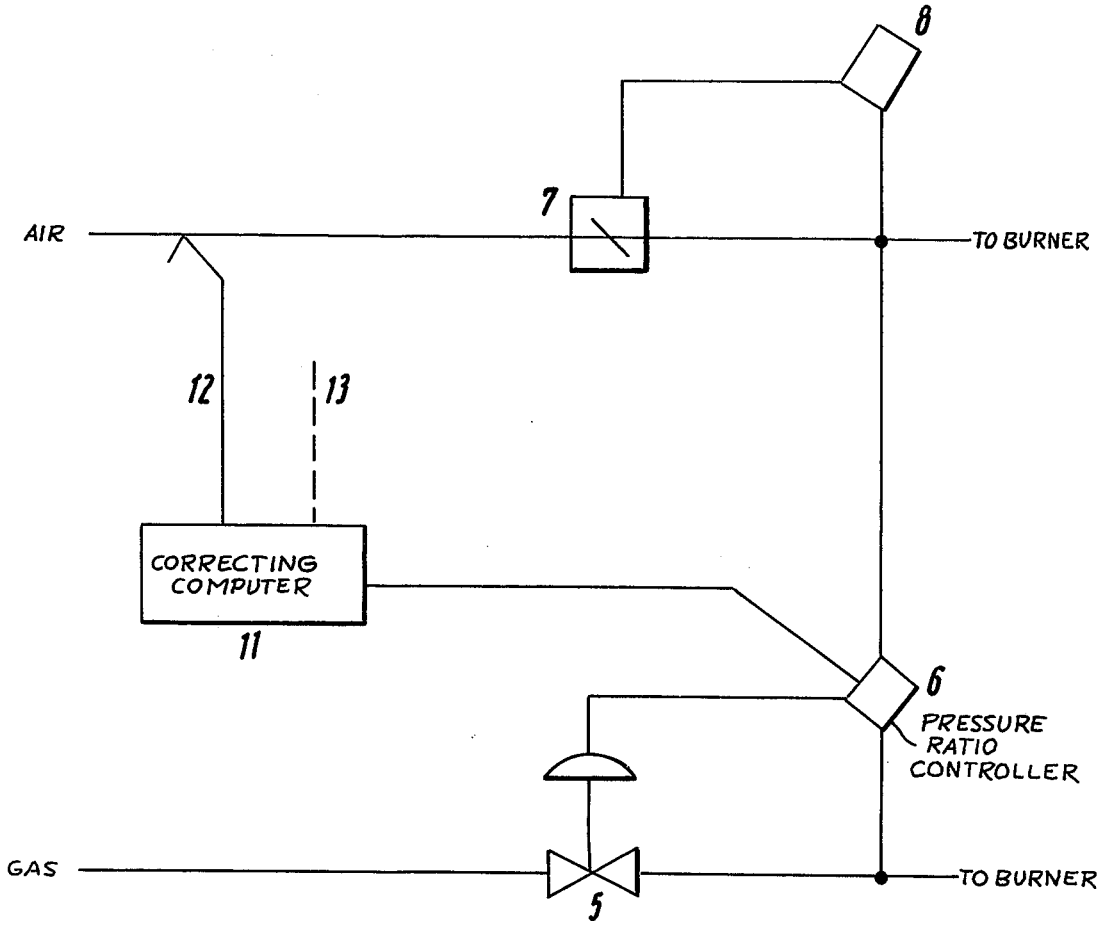

In FIG. 3, the ratio controller of FIG. 2 is designated 6. In this ratio controller, the set pressure ratio is modified by a suitably adapted, substantially known correcting computer 11, which effects a desired correction, e.g. in dependence of the air temperature sensed by a known sensor 12, or in dependence upon another process parameter 13, e.g., the continuously sensed oxygen content of the molten metal.

Figure 4:
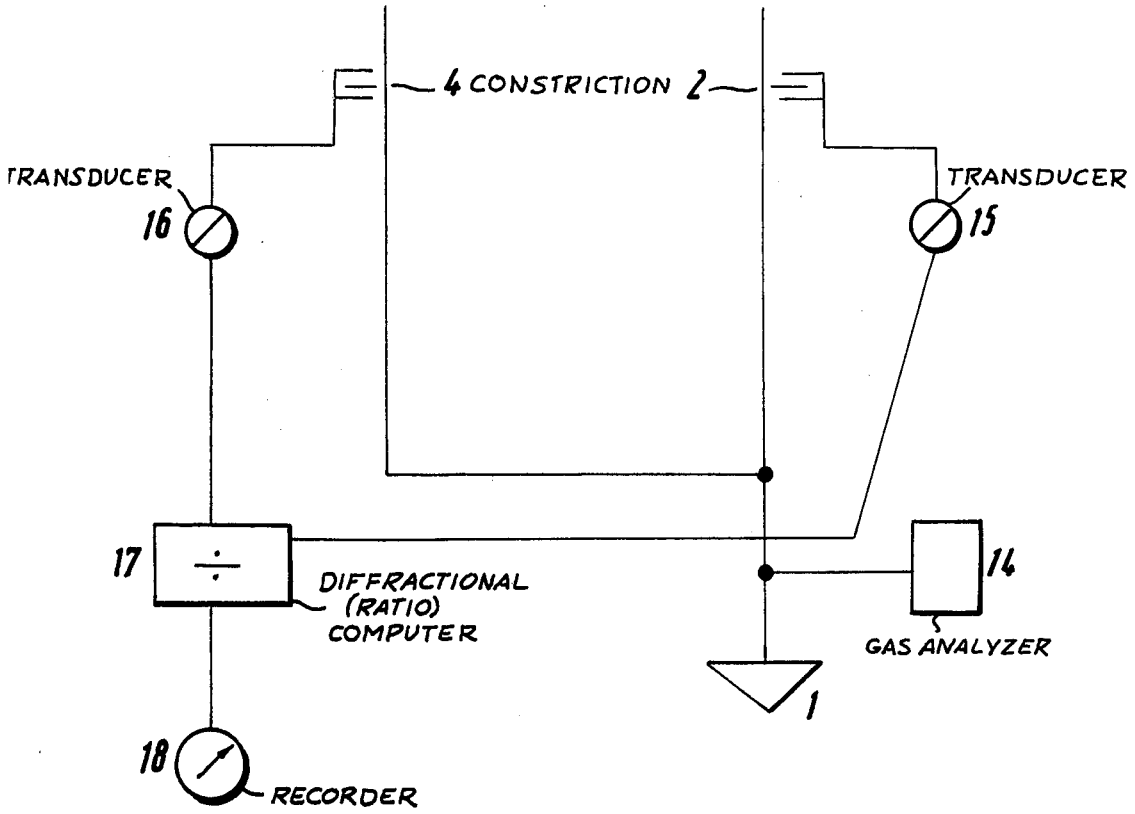
FIG. 4 shows two possible ways of monitoring the fuel-air ratio at the burner in accordance with the invention.

FIG. 4 shows two ways in which the resulting air-fuel mixture can be monitored. A widespread method involves the use of a gas analyzer 14 provided with suitably adapted auxiliary means, which are not specifically shown. In carrying out the mothod according to the invention it has been found particularly desirable to measure the mass flow rates of the air and fuel by means of actual restrictions 2 and 4 and transducers 15 and 16 having suitable measuring ranges and to comprise the ratio of the transducer outputs with means 17 known per se and to indicate and/or to record said ratio (18). Because such arrangements for measuring flow rate ratios produce an indication much faster than the analyzers 14, the transducer, computer, and indicator can be associated with a much larger number of burners than the analyzers 14 if the transducers are connected to cyclically opened and closed differential pressure conduits leading to the restrictions.

In the application of the method according to the invention it has been found that the use of both monitoring systems enables an association of a much larger number of burners with one indicating unit than in the known arrangement shown in FIG. 1 and comprising a zero regulator advancing each burner. This is due to the fact that the controlled pressures are highly constant.

A suitable pressure ratio controller is disclosed in PERRY'S CHEMICAL ENGINEERS' HANDBOOK, McGraw-Hill Book Company, 1963, Chapter 22. The gas analyzer may be any of those described at pages 22–31 ff. of PERRY'S CHEMICAL ENGINEERS' HANDBOOK whereas the computer may be a process control computer of the type described at pages 22–52 ff. of PERRY'S CHEMICAL ENIGINEERS' HANDBOOK.

We claim:

1. A method of independently adjusting a fuel-mixture composition and heating rate for a multiburner shaft furnace for melting metal wherein said shaft furnace comprises at least one more group of burners, respective first manifolds for feeding air to the burners of each of said groups, respective second manifolds for feeding a fuel gas to the burners of each of said groups, and respective control valves in each of said manifolds, said method comprising the steps of:

controlling the heating rate by sensing the pressure in one of the manifolds of each of said groups of burners and operating the valve of the said one of said manifolds of each group in dependence upon the sensed pressure; and detecting the pressure ratio between the first and second manifolds of each of said groups of burners and controlling the valve of the other manifold of the first and second manifolds of each of said groups of burners in dependence upon the detected pressure ratio with a single pressure-ratio controller, thereby adjusting the fuel-mixture compositions for the burners of said groups.

2. The method defined in claim 1 wherein the valve controlled by said pressure-ratio controller is connected in the respective second manifold for feeding fuel gas to the burners, the valve controlled in response to the sensed pressure in the said one of said manifolds being connected in the respective first manifold of said groups of burners for controlling the flow of air.

3. The method defined in claim 2, wherein means are provided to automatically control the ratio of the pressures in dependence upon the sensed temperature of the air conducted in each of the first manifolds thus compensating for changes in density.

4. The method defined in claim 2, further comprising the step of automatically controlling said pressure ratio in dependence upon the flow rate in each burner group to compensate for deviation of the dependence between flow rate and pressure loss from a precisely square function.

5. The method defined in claim 1 wherein the pressure of air and fuel gas in the respective manifolds is measured by a root-extracting instrument.

6. The method defined in claim 1 wherein the fuel gas is not preheated and is introduced into a mixing chamber ahead of each burner.

7. The method defined in claim 1, further comprising the step of monitoring said mixture of fuel gas and air fed to each burner by differential-pressure generators provided in the respective air and fuel gas piping, each of said restrictions being connectible to a transducer the outputs of which are connected to a ratio computer.

8. The improvement defined in claim 7 wherein differential pressure transducers and a ratio computer are associated with a plurality of restrictions in ducts communicating between said manifolds and said burners by means of switching valves.

9. The method defined in claim 1 wherein said manifolds are provided with final control valves, said method further comprising the step of automatically opening said final control valves in said air manifolds in the event of failure of the control system.

10. The method defined in claim 1 wherein said manifolds are provided with final control valves, said method furter comprising the step of automatically closing the final control valves of said fuel gas manifolds in the event of failure of the control system.

11. A control system for a shaft furnace for the smelting of lumps of metal, comprising:

a plurality of burners forming a first group and adapted to combust a mixture of air and a fuel gas for smelting metal in said furnace;

a plurality of burners forming another group or groups adapted to combust a mixture of air and fuel gas to smelt metal in said furnace;

respective first manifolds for feeding air to the burners of each of said groups;

respective second manifolds for feeding fuel gas to the burners of each of said groups, each of said manifolds being provided with a respective control valve; and control means for imdependently adjusting the fuel mixture composition and heating rate in said shaft furnace, said control means including respective pressure-sensing means, responsive to pressure in each of said first manifolds and operatively connected to the control valves thereof for controlling the pressure of the air in said first manifolds for each burner group;

a respective single pressure-ratio controller connected across to the first and second manifolds of each of said burner groups for producing an output representing the ratio of the pressures in the manifolds across with the pressure-ratio controller is connected; and means for applying the output of said pressure ratio controllers to the control valves of the respective second manifolds whereby the pressure ratio controller of each group of burners constitutes the sole controller for the fuel gas thereof.

* * * * *

UNITED STATES PATENT AND TRADEMARK OFFICE

CERTIFICATE OF CORRECTION

PATENT NO. : 4,065,250

DATED : 27 December 1977

INVENTOR(S) : Heinrich Schliefer et al

It is certified that error appears in the above-identified patent and that said Letters Patent are hereby corrected as shown below:

Column 4, line 45, for "at least one more group"

read: -- one or more groups --

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*